US009683385B1

(12) United States Patent
Huesdash

(10) Patent No.: US 9,683,385 B1
(45) Date of Patent: Jun. 20, 2017

(54) COLLAPSIBLE DRINK CABANA

(76) Inventor: Doug Huesdash, Ottawa, MI (US)

( * ) Notice: Subject to any disclaimer, the term of this patent is extended or adjusted under 35 U.S.C. 154(b) by 875 days.

(21) Appl. No.: 13/360,976

(22) Filed: Jan. 30, 2012

Related U.S. Application Data

(63) Continuation-in-part of application No. 12/657,403, filed on Jan. 20, 2010, now abandoned.

(51) Int. Cl.
*E04H 15/00* (2006.01)
*E04H 15/58* (2006.01)
*E04H 15/48* (2006.01)

(52) U.S. Cl.
CPC ..... *E04H 15/003* (2013.01); *E04H 15/48* (2013.01); *E04H 15/58* (2013.01)

(58) Field of Classification Search
USPC ..... 135/96, 130, 143, 144, 152, 157, 158, 135/160; 312/3, 6, 258, 265.1, 265.2, 312/265.3, 265.4
See application file for complete search history.

(56) References Cited

U.S. PATENT DOCUMENTS 1,394,007 A * 10/1921 Hall ..... A47B 43/04 312/6
2,010,472 A 8/1935 Angel
3,034,523 A 5/1962 De Shano
3,469,588 A 9/1969 Rainwater
4,664,266 A * 5/1987 Fausett et al. ..... 211/87.01
4,752,008 A * 6/1988 Pratt ..... 206/579
5,042,664 A * 8/1991 Shyr et al. ..... 206/579
5,263,507 A 11/1993 Chuang
5,511,254 A * 4/1996 O'Brien ..... 4/532
5,662,132 A 9/1997 Larsen
5,957,310 A * 9/1999 Mitchell ..... 211/186
6,036,289 A 3/2000 Marcoux
6,328,158 B1 12/2001 Bisbal et al.
7,357,140 B2 4/2008 Chu et al.
7,552,739 B2 6/2009 Chu et al.
7,775,230 B2 8/2010 Lau
7,878,345 B2 2/2011 Touriamain
2002/0050285 A1* 5/2002 Zheng ..... 135/126
2002/0060510 A1 5/2002 Choi
2002/0140260 A1 10/2002 Osato
2007/0079858 A1* 4/2007 Chu et al. ..... 135/126
2007/0215193 A1 9/2007 Flores

* cited by examiner

*Primary Examiner* — Noah C Hawk

(57) ABSTRACT

A portable collapsible drink cabana. The cabana consists of a frame work that is covered in material suitable for protecting drinks from the sun, and other materials, that are in use in a beach or outdoor setting. The expandable cabana is supported by the frame work that is supported by at least one interior shelf.

11 Claims, 2 Drawing Sheets

COLLAPSIBLE DRINK CABANA

This application is a continuation-in-part application of application Ser. No. 12/657,403, filed on Jan. 20, 2010, from which priority is claimed.

BACKGROUND OF THE INVENTION

The instant invention disclosed herein is a portable collapsible drink cabana. The cabana consists of a metal or plastic frame that is covered in material suitable for protecting drinks and other items that are in use in a beach or outdoor setting from the sun. The cabana has drink holders that protect refreshments from the sun and pockets that provide storage for other items that are usually used as the beach or in other relaxing situations. Storage of such items as book, sunscreens, watches, glasses, wallets and so on are now possible. It is also capable of supporting electronic equipment such as a MP3 player and multiple outlets for listening devices. One device can be enjoyed by multiple users at the same time. Additional storage pockets may be provided and could include at least one pocket that is detachable and transportable by a lanyard to keep valuables protected.

A patent search resulted in the discovery of the following patents: U.S. Pat. Nos. 2,010,472; 3,034,523; 3,469,588; 5,263,507; 5,662,132; 6,036,289; 6,328,158, 7,357,140; 7,552,739; 7,775,230, and 7,878,345, and publications 2002/0060510 A1; 2002/0140260 A1, and 2007/0215193 A1. None of these patents or publications appear to anticipate or make obvious the instant invention.

THE INVENTION

The instant invention is A collapsible drink cabana comprising in combination a supporting frame work consisting of a first side and a second side. It has a flexible covering over the supporting frame work and has at least one interior shelf having four corners on the same plane and being selected from the group consisting of a rigid structure, and a flexible structure with perimeter support. Each of the first side and second side have a top configuration that is hooped.

Each of the interior shelves are supported by belts running from the first side to the second side, near the four corners of each interior shelf.

The collapsible cabana is ideal for sheltering beverages, storing keys and mp3 players and large enough to hold a tablet pc, such as an IPad. The cabana is completely collapsible for portability and storage. The inside shelf provides ample space to store personal items where clothing pocket space is undesirable or unavailable. The shelf also has drink holders incorporated within it to hold beverages. The cabana is useful at the beach, parks or just the back yard. An mp3 player can be connected to the cabana and supply multiple sets of listening devices for multiple users. When collapsed the cabana folds virtually flat and has straps or handled that allow it to be carried easily.

DETAILED DESCRIPTION OF THE DRAWINGS

Figure 1:
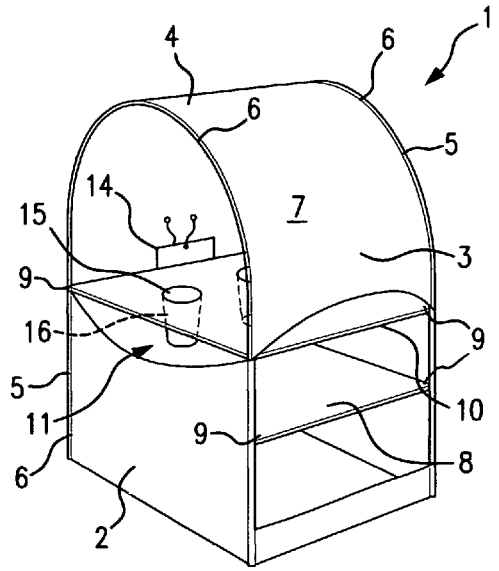
FIG. 1 is a view in perspective of a cabana of this invention showing a side and an end.
Figure 3:
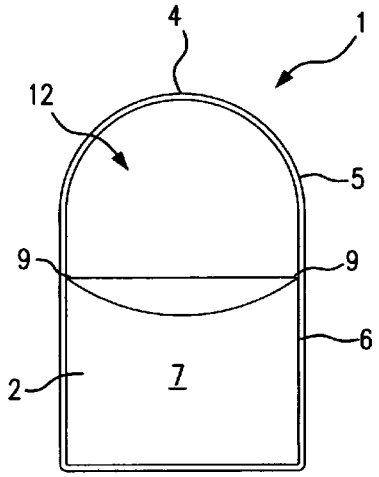
FIG. 3 is a full side view of a cabana of this invention.

Turning now to the Figures, there is shown in FIG. 1 a view in perspective of a cabana of this invention showing a full side 2 and a full end 3. As shown in the Figures, the cabana 1 has a hooped top 4 (shown best in FIG. 3) that is supplied by the use of a support frame 5 fashioned from metal, plastic, wood, fiberglass and the like. Preferred are plastic and fiberglass, and most preferred is fiberglass. Typically, the support frame 5 is sewn into a rib or seam 6 as is shown in FIG. 3. However, because of the fact that the support frame 5 is sewn into the fabric seam 6, the actual support frame 5 cannot be directly observed.

The support frame 5 is covered by a flexible covering 7, such as cloth, nylon, canvas, plastic and the like, it being preferred to use nylon and canvas, and especially useful is nylon.

The interior of the cabana 1 is fitted with at least one shelf 8, and it is contemplated within the scope of this invention to use at least two such shelves. Each of the shelves have four corners 9. The shelves 8 are held within the confines of the cabana 1 by belts 10 that are attached to the fabric covering 7. The belts 10 are fastened such that the stretch from side to side of the cabana 1 at both the back 11 of the cabana 1 and near the front 12 of the cabana 1 near the corners of the shelves 8.

When a shelf 8 is laid on top of the belts 10 and pressed down, the fabric of the flexible covering 7 and the belts 10 give enough to snug the shelf 8 down and thereby keep the cabana 1 extended. To collapse the cabana 1, the shelves 8 are simply removed and the cabana 1 collapses unto itself.

Figure 2:
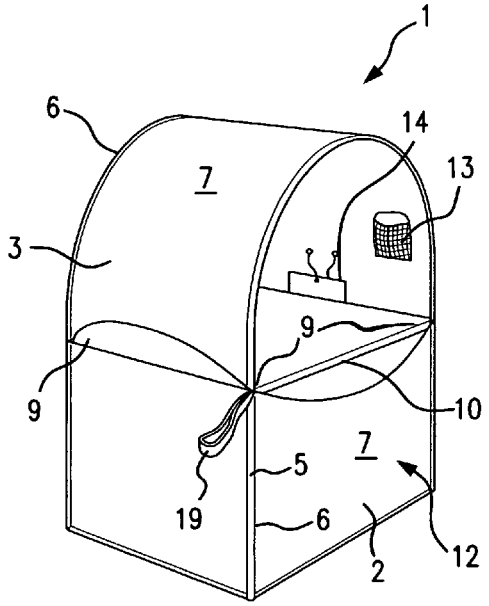
FIG. 2 is a view in perspective of a cabana of this invention showing a side and an end view.

The fabric of the flexible covering 7 has pockets 13 sewn into it to store various items normally needed in an outing (see FIG. 2). In addition, it is contemplated within the scope of this invention to provide an MP3 splitter 14 for the cabana 1 as shown in FIG. 1 wherein the splitter 14 is associated with the shelf 8, and in FIG. 2 wherein the splitter 14 is associated with the flexible fabric covering 7.

The shelves 8 also have one or more openings 15 in them to accommodate drink containers. The openings 15 have container holders 16 shown in phantom in FIG. 1 to prevent the drink containers from slipping through the openings 15.

Figure 5:
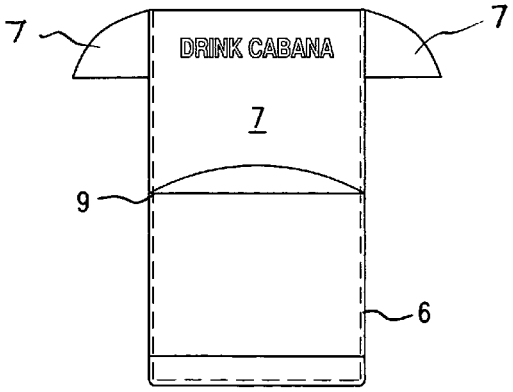
FIG. 5 is a full end view of a cabana of this invention showing canopies on the front and back.

In FIG. 5, there is shown the use of a canopy 17 on the cabana 1. It is contemplated within this invention to provide a canopy 17 on both the front 12 and the back 11 of the cabana 1.

Figure 4:
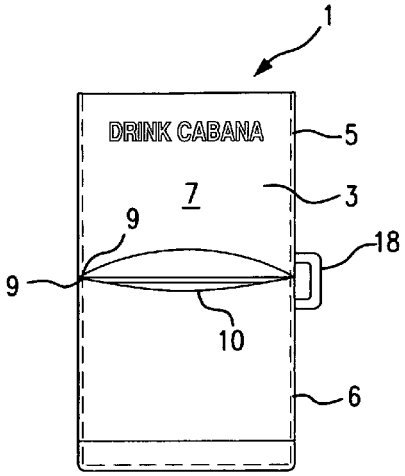
FIG. 4 is a full end view of a cabana of this invention.

As noted in FIGS. 4 and 5, the flexible fabric covering 7 can be used to advertise. Also, FIG. 2 shows a carrying strap 19 for the cabana 1, and FIG. 4 shows a carrying handle 18 for the cabana 1.

What is claimed is:

1. A collapsible drink cabana comprising in combination a supporting frame work consisting of a first side and a second side;

a flexible covering over the supporting frame work;

at least one interior shelf having four corners on the same plane and being selected from the group consisting of:

i. a rigid structure, and ii. a flexible structure with perimeter support, each said first side and second side having a top configuration that is hooped;

each said interior shelf being supported by belts running from the first side to the second side, near the four corners of each interior shelf such that the shelf provides tension in said flexible covering and against said supporting frame work.

2. A collapsible drink cabana as claimed in claim 1 wherein, in addition, said covering is canvas.

3. A collapsible drink cabana as claimed in claim 1 wherein, in addition, said framework is metal.

4. A collapsible drink cabana as claimed in claim 1 wherein, in addition, said framework is plastic.

5. A collapsible drink cabana as claimed in claim 1 wherein, in addition, said framework is fiberglass.

6. A collapsible drink cabana as claimed in claim 1 wherein, in addition, said covering is plastic.

7. A collapsible drink cabana as claimed in claim 1 wherein, in addition, said covering is nylon.

8. A collapsible drink cabana as claimed in claim 1 wherein, in addition, said covering is cloth.

9. A collapsible drink cabana as claimed in claim 1 wherein, in addition, said cabana has more than one interior shelf.

10. A collapsible drink cabana as claimed in claim 1 wherein, in addition, said framework is inserted within the covering via a sewn seam.

11. A collapsible drink cabana as claimed in claim 1 wherein, in addition, said fabric covering contains advertising thereon.

* * * * *